US006161824A

United States Patent [19]

Gustavson

[11] Patent Number: 6,161,824

[45] Date of Patent: Dec. 19, 2000

[54] WALLBOARD INSTALLATION FACILITATING TOOL

[76] Inventor: Ido H. Gustavson, P.O. Box 741, Micanopy, Fla. 32667

[21] Appl. No.: 09/074,732

[22] Filed: May 8, 1998

[51] Int. Cl.[7] ..... B23Q 3/02

[52] U.S. Cl. ..... 269/43; 269/101; 269/102; 269/904

[58] Field of Search ..... 269/43, 45, 41, 269/102, 101, 904, 37; 248/300, 248, 544; 24/464; 52/DIG. 1; 33/645, 646, 647, 648, 649

[56] References Cited

U.S. PATENT DOCUMENTS 2,321,916 6/1943 Ingerman ..... 248/300
5,207,126 5/1993 Schaben ..... 254/25
5,407,183 4/1995 Singeltary ..... 269/904
5,575,223 11/1996 Hendel ..... 248/300
5,695,172 12/1997 Hreha ..... 254/25

*Primary Examiner*—Robert C. Watson

[57] ABSTRACT

A tool useful in the installation of wallboard, especially on ceilings, having two surfaces at a substantially right angle to each other, or a single surface, with means for attachment of said tool in appropriate locations as a means of providing temporary support for wallboard during installation.

3 Claims, 2 Drawing Sheets

WALLBOARD INSTALLATION FACILITATING TOOL

BACKGROUND

1. Field of Invention

This invention relates to the installation of wallboard in the building or remodeling of residential or commercial buildings.

2. Description of Prior Art

Gypsum wallboard has been used for many decades in covering interior walls and ceilings in all kinds of building construction. Such boards are most commonly four feet wide by eight feet long or longer and of considerable weight, whereby difficulties are experienced by installers, whether professionals or amateurs, in installing such boards, especially on ceilings. A board must be supported in an overhead position by at least two workers, who must carefully position it with respect to previously installed boards or the wall, and while holding it in this position, secure fasteners and a driver (hammer or screwdriver) and drive in enough fasteners to hold the board in place without allowing it to move out of place before being able to drive in such fasteners. Because a weight can be supported for only a relatively short time before fatigue is encountered, a board may be fastened in place before correct alignment is achieved or after alignment is lost because of inability to hold the board in position for the required time.

Some fabricate a support of wood consisting of a ceiling-length piece of same and a crosspiece nailed to the top and then move this support into position under the piece of wallboard while holding the board against the ceiling joists. This is an awkward and difficult method. If the board is pressed sufficiently against the ceiling joists, it is impossible to move it into correct alignment.

There is on the market a fabricated jacking device on which a peice of wallboard can be placed in a horizontal position at a convenient height and then jacked up to the ceiling. This device is rather elaborate in design and awkward to handle; it is also expensive to own or rent. Both above-mentioned devices are difficult or impossible to use with slanted or cathedral type ceilings.

OBJECTS AND ADVANTAGES

The general object of my invention is to make the work of installing wallboard easier. Some of the advantages of of my invention are:

(a) the work of installing wallboard (most generally gypsum board), of all sizes, on ceilings, both level and slanted or cathedral type, becomes much easier both for the professional and non-professional;

(b) alignment mistakes will be easier to avoid;

(c) it will be possible to reduce the size of a workcrew, thus reducing the cost of labor;

(d) the projected cost of owning a copy of my invention will be such that practically everyone who does or contemplates doing the kind of work discussed will not hesitate to buy my invention;

(e) the small size and light weight will make this invention very convenient to use, transport and store.

DRAWING FIGURES

REFERENCE NUMERALS IN DRAWINGS

Figure 1:
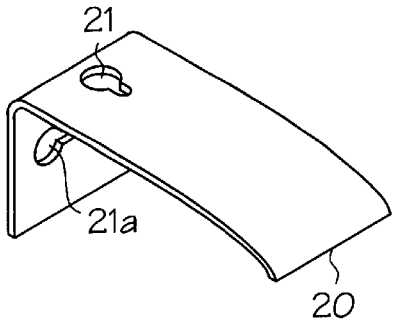
FIG. 1 shows a perspective view of wallboard installation facilitating tool.

20 wallboard installation facilitating tool
21, 21*a* keyhole-shaped hole
22 cross-sectional view of previously installed board
23 cross-sectional view of board in process of installation
24 fastener
25 ceiling joist
26 wall framing Description—FIGS. 1 to 5

Figure 2:
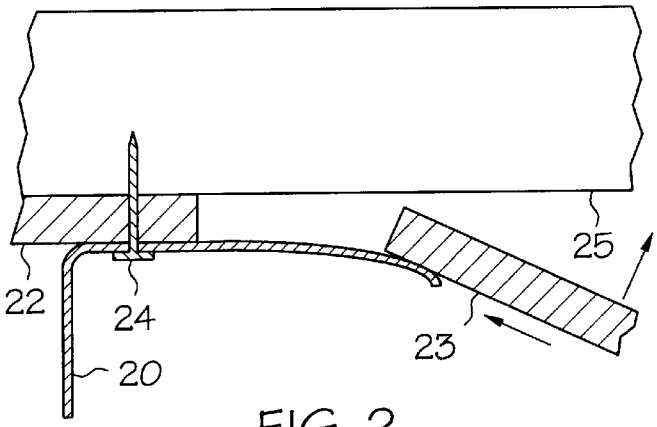
FIG. 2 shows a side view of tool in place ready to receive next piece of wallboard.
Figure 3:
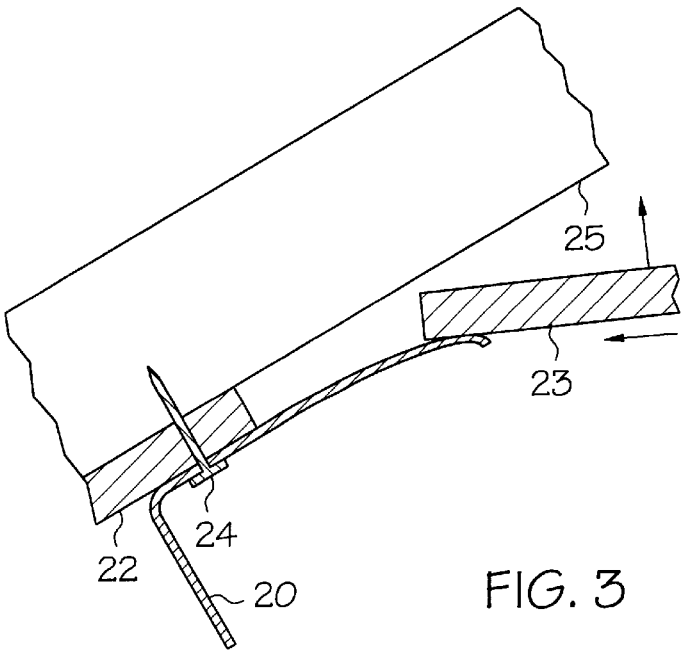
FIG. 3 is essentially same as FIG. 2, except the ceiling is of the slanted or cathedral type.
Figure 4:
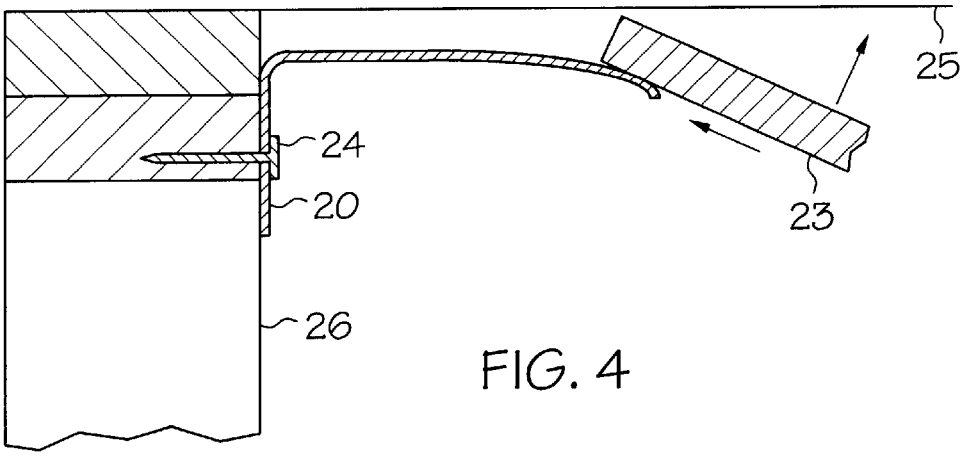
FIGS. 4, 5 show tool in place attached to wall to receive initial board.
Figure 5:
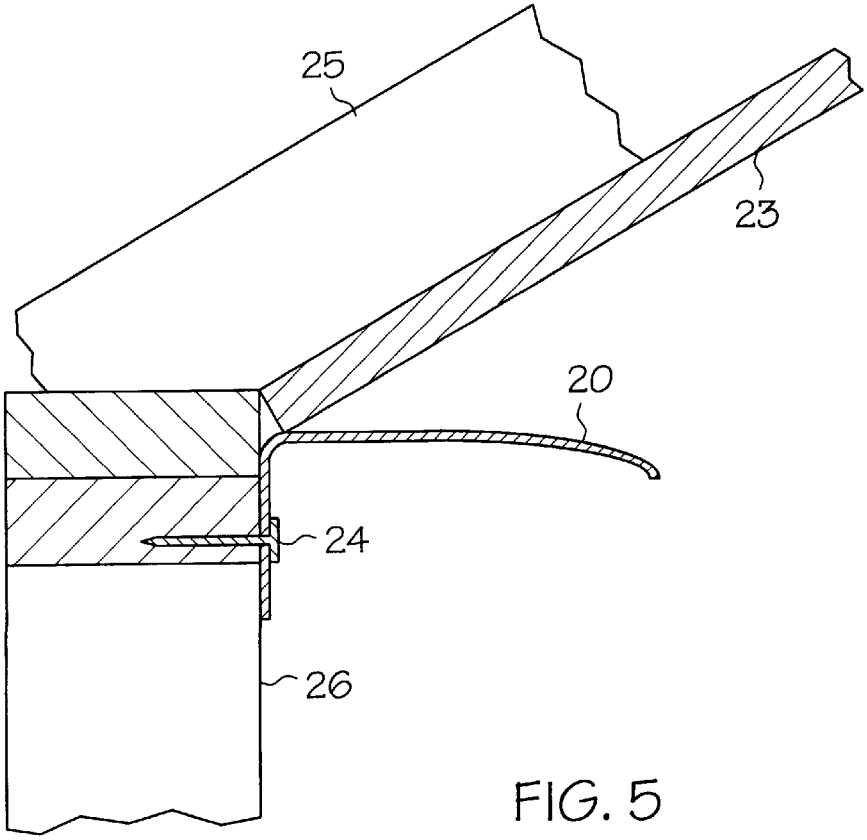

A typical embodiment of this invention is illustrated in FIG. 1 (perspective view) and FIG. 2 (side view of invention in use). FIGS. 2, 3, 4, and 5 illustrate method of use in construction of flat and slanted or cathedral type ceilings. FIG. 4 illustrates use of tool for the installation of initial board against a wall or the installation of last board. FIG. 5 illustrates use of tool for installation of initial board in a slanted or cathedral type ceiling. FIGS. 2 and 3 illustrate method of use of tool in the installation of subsequent boards, after the initial board has been installed. Keyhole-shaped holes are shown by 21 and 21*a* in FIG. 1. Round holes can also be used, either alone or alongside of keyhole-shaped holes. If FIG. 2 is rotated 90 degrees counterclockwise, the method of using tool for installation of boards on wall would be illustrated.

Manner of Use—FIGS. 2, 3, 4, and 5

In the installation of wallboard on ceilings, typically the first boards are installed against a wall. FIG. 4 illustrates tool installed unto wall framing with fastener passing through hole 21*a*, with sufficient clearance allowed, depending on thickness of wallboard being installed, between ceiling joist and top of tool to allow board to be moved against wall framing. Since tool (typically two or more are used) is fastened to wall or ceiling framing, a steady support is provided for board being installed, relieving installers of one half the weight of board, permitting greater freedom of hands in securing and installing initial fasteners into board. Achieving proper alignment is easier since tool holds board at proper height to simply move into final position by pushing, as indicated by arrows parallel to face of board in FIGS. 2, 3, and 4. Typically at least two workers are required to handle a four by eight feet piece of gypsum wallboard, positioning themselves more or less centrally under it, making visual confirmation of alignment difficult or impossible. Since my invention supports half the weight of a piece of wallboard, one worker can support the side of a board opposite the installed tool(s) of this invention, the other can easily move into position to obtain visual confirmation of correct position of board. FIGS. 2 and 3 illustrate use of tool in the installation of boards on ceilings after initial board has been installed. Tool is installed on top of previously installed board, providing proper clearance between ceiling joist and tool automatically, and preventing any possibility of board overriding previously installed board. Since simple pushing and lifting is sufficient to achieve correct positioning rapidly, installers are far less likely to experience loss of strength from fatigue before sufficient number of fasteners can be installed. Typically the same fasteners can be used to install the facilitating tool(s) as are used to install wallboard, whether nails or screws. Keyhole-shaped holes 21 and 21*a* permit easy removal of tool by simple sideward movement of tool.

A version of tool shown in FIG. 1 comprising only of the horizontal part through which hole 21 passes, useful in situations illustrated by FIGS. 2 and 3.

SUMMARY

This invention will make the installation of wallboard, typically gypsum board, on ceilings of all types much easier. This tool is easy to install in position and remove, very convenient to handle and carry, remarkably inexpensive for the labor and effort saved. It can be fabricated from various common materials, with modifications for engineering and design reasons.

The unexpectedly new and valueable results obtained by the use of this invention will become apparent immediately after one instance of actual use.

I claim:

1. A tool for temporarily retaining wallboard, for ease of installation, against either flat surfaces or corners including ceilings, vertical walls and sloped surfaces, the tool comprising:

a flat first portion having a first end and a second end;

a second portion extending at right angles from the first end, the second portion having a distal end sloping toward the first portion second end;

the first portion having at least one hole for receiving a fastener to fix the first portion against a surface; and the second portion having at least one hole for receiving a fastener to fix the first portion against a surface.

2. A tool according to claim 1, wherein:

the holes are keyhole shaped.

3. A tool according to claim 1, wherein:

the tool is metallic.

* * * * *